United States Patent [19]

Durant

[11] 4,229,886

[45] Oct. 28, 1980

[54] MICROWAVE HEATED VACUUM DRYER FOR POWDERS

[75] Inventor: Dick Q. Durant, Manchester, Mo.

[73] Assignee: McDonnell Douglas Corporation, Long Beach, Calif.

[21] Appl. No.: 18,899

[22] Filed: Mar. 9, 1979

[51] Int. Cl.[3] ..... F26B 13/30

[52] U.S. Cl. ..... 34/92; 13/31 EB; 34/4; 219/10.55 A; 219/10.55 M

[58] Field of Search ..... 34/92, 4, 242; 432/203, 432/205; 13/31; 219/10.55 A, 10.55 M

[56] References Cited

U.S. PATENT DOCUMENTS

| | | | |
|---|---|---|---|
| 2,705,137 | 3/1955 | Haltmeier | 432/205 |
| 3,007,690 | 11/1961 | Koniewiez . | |
| 3,409,447 | 11/1968 | Jeppson | 34/1 |
| 4,045,639 | 8/1977 | Meisel | 219/10.55 A |

*Primary Examiner*—John J. Camby

*Attorney, Agent, or Firm*—George W. Finch; Walter J. Jason; Donald L. Royer

[57] ABSTRACT

A source of microwave energy is introduced into a pressure vessel in which a vacuum is drawn. Powdered materials to be dried are introduced and removed from the vessel by screw conveyors which are long enough so that in combination with the material, they prevent the loss of the vacuum in the vessel. The materials are transported through the vessel as the moisture is removed therefrom at essentially ambient temperatures. A water vapor condenser is also included within the pressure vessel to reduce the vacuum pumping requirements thereof.

23 Claims, 4 Drawing Figures

MICROWAVE HEATED VACUUM DRYER FOR POWDERS

CROSS-REFERENCE TO RELATED PATENT

The subject matter of the present application is related to U.S. Pat. No. 4,015,341 entitled "Seed Drying Process and Apparatus" which issued to H. F. McKinney, Nathan L. Higginbotham and Dick Q. Durant on Apr. 5, 1977, and reference is made thereto as though fully set forth therein below.

BACKGROUND OF THE INVENTION

Finely powdered products, such as coal fines, ore and other mineral fines, pharmaceutical powders, cosmetic powders and the like, are often dried using fluidized-bed heat exchangers with hot air being used as the fluidizing medium. In addition to fluidizing the powder bed, the hot air heats the powder to drive off the moisture contained therein and acts as a vehicle to carry off the vaporized moisture. The exhaust air for such heat exchangers usually is highly contaminated with fine powder carry-over which must be run through a cyclone separator to recover the carry-over and also an exhaust scrubber to reduce the resulting air pollution to an acceptable level. The equipment required for such a dryer is, at a minimum, a blower, an air heater, a fluidizing vessel, a product conveying system, a cyclone separator, an exhaust air scrubber, and the connected piping. From the product standpoint, this dryer produces highly stratified, loose dusty powder which generally is undesirable. From an energy standpoint, such systems are quite wasteful since the air must be heated to a sufficiently high temperature to vaporize the moisture. The heated air elevates the temperature of the above mentioned equipment thereby contributing to significant heat loss in addition to the loss involved in raising the temperature of the air which is exhausted.

In some operations, such as coal mining, environmental considerations have required the expenditure of much more energy to recover the coal fines than is available from the fines and therefore is inherently wasteful. Also, in many coal mines, the total volume of coal fines which must be dried is so great as to undesirably effect the economic operation of the entire mine.

Microwave heated fluidized-bed dryers such as shown in U.S. Pat. No. 3,528,179 to F. J. Smith are known wherein the operation of a fluidized-bed dryer is improved through the application of microwave energy. However, such does not remove the limitations of fluidized-bed dryers which require complex separation equipment at their outlets to separate the fluidizing medium from the dried product as described above. Microwave energy also has been used to dry food products such as is shown by Jeppson in U.S. Pat. No. 3,409,447 whereas vacuum dryers are described by J. R. Richardson and R. Elwess in U.S. Pat. Nos. 1,920,107 and 2,799,947 respectively. All of the above patents were cited in U.S. Pat. No. 4,015,341 referenced above whose disclosed apparatus is primarily concerned with drying seed in a manner which improves its percentage of germination when compared to previously used methods. The device of U.S. Pat. No. 4,015,341 introduces microwave energy and seeds into a low pressure environment so that the seeds are dried at essentially ambient temperatures and with greatly reduced energy requirements when compared to other electrical dryers.

SUMMARY OF THE INVENTION

The present invention is an apparatus which subjects powder or other similar material having a moisture content over that desired, to microwave energy within an atmosphere of reduced pressure so as to vaporize the water at a relatively low temperature to remove it from the material. The apparatus includes a pressure vessel from which air is evacuated until the pressure within the vessel is below 500 mm Hg. While the material is within the low pressure environment of the pressure vessel, it is subjected to microwave energy generated by a suitable microwave power unit. This energy is directed or channelled into the interior of the pressure vessel by one or more wave guides which pass through the wall thereof. In other words, the microwave source is located externally of the pressure vessel but the electromagnetic waves it generates are directed into the interior of the vessel through the wave guides and into the region in which the material is present. The material enters the pressure vessel through a screw conveyor whose length is sufficient to prevent the loss of vacuum within the pressure vessel with the material acting as a plug within the screw. The outlet of the inlet screw conveyor dumps the material into a bin from which it is metered onto a moving conveyor belt which passes the material into a chamber where the water in the material is heated to its vapor state by the microwave energy. For lossy or thick materials, means may be provided along the belt to stir the material as it is subjected to the microwave energy and the vacuum simultaneously. The speed of the belt is controlled so that the material is at its desired moisture content when its passes out of the microwave chamber and into a second bin where it is conveyed out of the pressure vessel by an outlet screw conveyor similar to the inlet screw conveyor. Since the process is conducted at reduced pressure, the temperature necessary to vaporize the moisture in the material need not be higher than the ambient temperature thereby greatly reducing heat loss and enhancing efficiency of the overall apparatus. In addition, the present dryer does not needlessly pollute the air in the vicinity of the dryer since no blown air is circulated. A homogeneous output product is maintained because of the relative static drying process. When the water vapor leaves the material, it passes through vents in the microwave chamber to a condenser where it condenses into a sump. The condensate then can be removed either by a sump pump or by draining into a condensate vessel which can be periodically vented and drained.

The present dryer can be operated at temperatures much below ambient if the condensor is cryogenically cooled and the vacuum capacity is boosted to achieve a harder vacuum. Such a device can be used as a freeze dryer for such products as coffee, artificial sweetners, pharmaceuticals and the like.

It is therefore an object of the present invention to provide an improved apparatus for drying powder and granular material in an energy efficient manner.

Another object is to provide a vacuum microwave dryer which can be scaled from the relatively small requirements of cosmetic manufacturers to those of large coal and mineral mines.

Another object is to provide means for reducing the energy requirements to maintain a desired vacuum in a microwave vacuum drying apparatus.

Another object is to dry powder with little or no increase in the temperature thereof.

Another object is to provide an apparatus which can use electric power rather than fossil fuel energy to dry powdered products.

These and other objects and advantages of the present invention will become apparent to those skilled in the art after considering the following detailed specification which describes a preferred embodiment thereof in conjunction with the accompanying drawings.

DETAILED DESCRIPTION OF THE SHOWN EMBODIMENT

Figure 1:
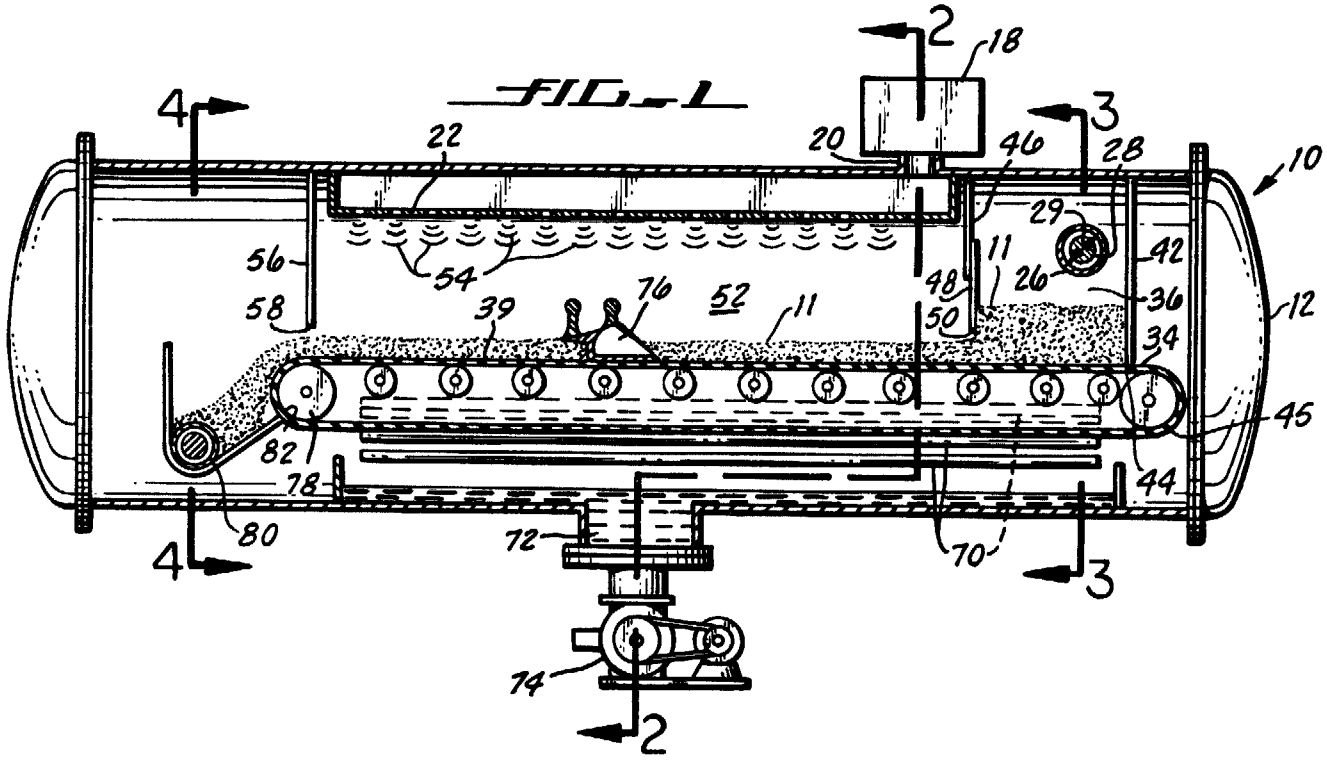
FIG. 1 is a side cross-sectional view of the present invention in operation drying powdered material.
Figure 2:
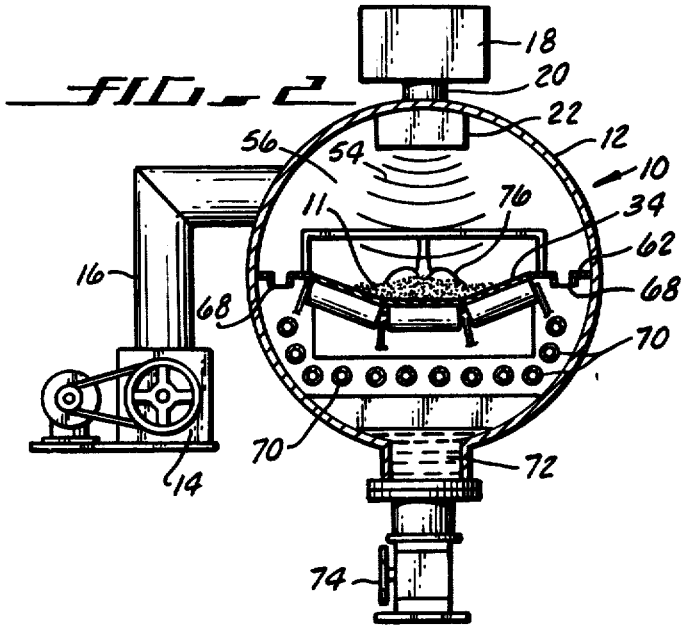
FIG. 2 is a cross-sectional view taken at line 2—2 of FIG. 1.
Figure 3:
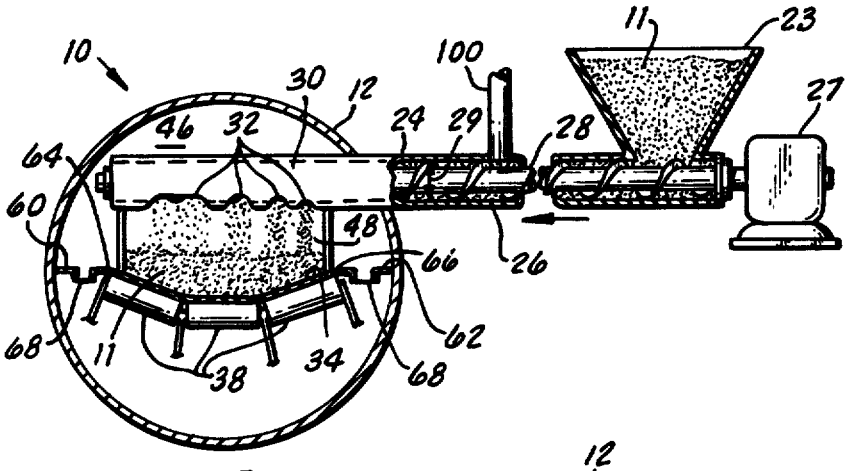
FIG. 3 is a cross-sectional view taken at line 3—3 of FIG. 1 showing the inlet portion thereof.
Figure 4:
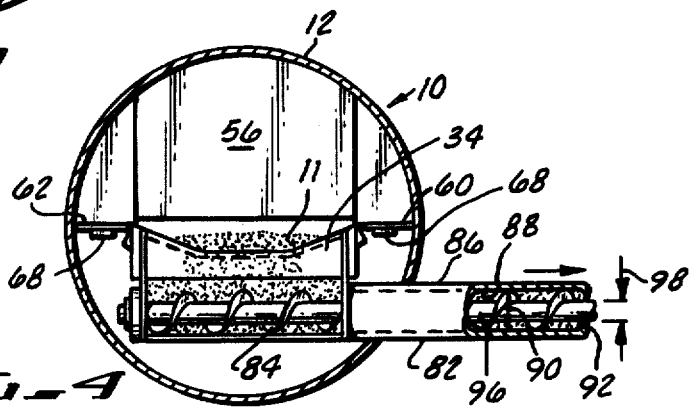
FIG. 4 is a cross-sectional view taken at line 4—4 of FIG. 1 showing the outlet portion thereof.

Referring to the drawings more particularly by reference numbers, number 10 in FIG. 1 refers to a microwave heated vacuum dryer apparatus for powder material 11 constructed according to the present invention. The apparatus 10 includes a pressure vessel 12 in which the pressure is reduced by a suitable vacuum pump 14 (FIG. 2) connected thereto by appropriate piping 16. Microwave energy is fed into the vessel 12 from one or more microwave power units 18 through suitable wave guide 20 and a microwave applicator 22 positioned within the vessel 12.

The vacuum pump 14 is used to evacuate air from the vessel 12 until the pressure within the vessel 12 is below 500 mm Hg. The reduced pressure is chosen because the boiling temperature of water lowers as the pressure is lowered. With the pressure from 5 mm Hg. to 50 mm Hg., a glow discharge phenomena occurs when microwave energy is applied. The glow discharge phenomena can reduce the water heating efficiency of the microwave energy however it has proved to be a problem only in special instances. The microwaves may be at any frequency within the range which excites water molecules. In this regard it is known that microwave energy within the frequency range of about $10^2$ MHz to $10^4$ MHz will cause water molecules to oscillate at the frequency of the waves. This oscillation generates heat, and the heat which is generated is enough to elevate the temperature of the water to its boiling point, provided, of course, that the microwave field is sufficiently powerful and the pressure is sufficiently low. The lower frequencies are generally more desirable when larger dryers are contemplated because lower frequency microwave energy penetrates deeper and the associated equipment is larger and easier to handle.

The material 11 to be dried is input to the vessel 12 from a bin 23 by means of an inlet screw conveyor 24. The conveyor 24 includes a tube 26 with a motor 27 driven rotating worm screw 28 positioned therein whose inner circumference and outer screw diameters 29 are substantially equal. The density of the material 11 to be dried and the hardness of the vacuum that is desired within the vessel 12 determines the required length for the inlet screw conveyor 24 so that the material 11 in the conveyor 24 and the bin 23 acts like a plug to prevent air from flowing past the worm screw 28 to increase the pumping load to which the vacuum pump 14 is subjected. An outlet end 30 of the conveyor 24 is provided with a series of graduated holes 32 arranged to distribute the material 11 laterally on a conveyor belt 34 within an input hopper 36 in the vessel 12. The conveyor belt 34 is supported by a plurality of rollers 38 positioned to shape the upper portion 39 of the belt 34 into a trough 40 for transport of the material 11 through the apparatus 10 for drying thereby.

The hopper 36 includes a back wall 42 whose lower edge 44 is shaped to conform to the shape of the belt 34 adjacent the back roller 45 thereor so that the material 11 cannot escape between the belt 34 and the wall 42. The front wall 46 of the hopper 36 may include a movable baffle 48 whose vertical position controls the thickness of the material 11 that can pass under its lower edge 50. The wall 46 also acts as the back wall of a microwave chamber 52 in which the material 11 is subjected to heating by application of microwave energy, shown diagrammatically at 54, which emanates from the microwave applicator 22. The chamber 52 is further defined by a front wall 56 whose lower edge 58 may be adjustable in elevation to accommodate various levels of material 11 yet assure a reasonably closed chamber 52. Perforated shields 60 and 62 are provided along the sides 64 and 66 of the belt 34 which with the belt 34 and the vessel 12 substantially close the chamber 52. Perforations 68 are provided in the shields 60 and 62 to allow water vapor to escape from the microwave chamber 52 to a condenser tube array 70 beneath the belt 34 which condenses the vapor back into liquid water. The condensed water collects in a sump 72 under the array 70 and is pumped out of the vessel 12 by suitable means such as the sump pump 74.

The use of a condenser tube array 70 is preferable to merely pumping the water vapor out with the vacuum pump 14 since less pumping energy is required when fluid is being pumped rather than gas. To operate properly, the condenser tube array 70 must be kept at a temperature below the boiling point of water for the particular vacuum within the vessel 12. However, if the temperature is below the freezing point of water, which may be very close to the boiling point at greatly reduced pressures, mechanical means must be provided to remove the ice so formed. Since water boils at 107° F. at 60 mm Hg., the operating vacuum is chosen taking into account the ambient temperature expected and the availability of suitable coolant. For example, in a warm climate where cold well water is available, the apparatus 10 could be operated at 50 mm Hg. and the condenser tube array be cooled by available well water so that a minimum of energy is expended. In a cold environment, it might be more efficient to lower the pressure in the vessel 12 much more so that the temperature of the material 11 does not have to be raised greatly to promote vaporization of the water and drying thereof, and yet suitable refrigerant or coolant can be used in the condenser tube array 70 by means such as the heat pipes described in U.S. Pat. No. 3,935,900. In some environments it may prove desirable to operate the apparatus 10 at a higher pressure during the summer and at a lower pressure during the winter.

For materials 11 which tend to heat unevenly when subjected to microwave energy, a stirrer, such as the plow share 76 shown, may be mounted within the chamber 52 to turn the material 11 after it has passed approximately halfway through the chamber 52 so that the material 11 is dried more evenly.

Once the material 11 has been dried to the desired extent, which can be controlled both by the intensity of the microwave application and the speed at which the belt 34 passes the material 11 through the chamber 52, the material 11 is dropped off of the belt 34 as the belt passes over its end roller 78 which transitions the belt 34 flat and dumps the material 11 into an outlet hopper 80. One edge 82 of the outlet hopper 80 can be positioned adjacent the belt 34 and the roller 78 so that it acts like a scraper to assure that the material 11 does not adhere to the belt 34 to later dislodge and foul the condenser tube array 70 which is positioned generally below the belt 34. The material 11 is removed from the hopper 80 by an outlet screw conveyor 82 which includes a motor driven rotating worm screw 84 in a suitable pipe 86 whose inner cylindrical surface 88 is formed having a diameter essentially equal to the outer diameter 90 of the worm screw 84. The conveyor 82, like conveyor 24, has a length chosen to assure that the material 11 acts as a plug to prevent the loss of vacuum within the vessel 12. This length usually is longer than the length required for conveyor 24 even though the direction of rotation of the screw 84 assists in the maintenance of the vacuum, because drier material usually has less substance. The worm screw 84 also breaks up the material 11 should it have a tendency to cake and assures that a homogeneous product is presented at the output end 92 of the conveyor 82. Of course, pressure lock hoppers (not shown) can be used where a severe vacuum is needed or when the material 11 is too light or granular to properly act as a plug. Suitable control means known in the conveyor art can be employed to control the speed of the conveyors 24 and 82 to assure that the material 11 does not pile up at some location in the apparatus 10 and to assure that the material levels do not fall so low that the vacuum is broken. It also may be desirable to use worm screws whose inner cylindrical portion 96 has a diameter 98 which is up to 80% of the diameter 90 of the screw 84 of the conveyor. If the material 11 is so granular that air is likely to be conveyed therewith, a connection to the vacuum pump may be connected at an intermediate location 100 along the pipe 26 or 86 so that the air can be removed from a smaller volume than that of the pressure vessel 12.

Thus there has been shown and described a novel apparatus for drying powder or finely granulated material which fulfills all the objects and advantages sought therefor. Many changes modifications, variations, uses and applications of the subject apparatus will become apparent to those skilled in the art after considering this specification and the accompanying drawings. All such changes, modifications, alterations and other uses and applications which do not depart from the spirit and scope of the invention are deemed to be covered by the invention which is limited only by the claims which follow.

What is claimed is:

1. A dryer for material including:

a pressure vessel having an inlet end and an outlet end;

means for reducing the pressure within said vessel;

means for introducing microwave energy into said vessel;

means for transporting the material in the vessel from the inlet end to the outlet and while the material is being subjected to microwave energy at the reduced pressure for at least a portion of the travel thereof;

a first continuous conveyor for transporting the material into said inlet end of said vessel while the reduced pressure is maintained; and a second continuous conveyor for transporting the material from said outlet end of said vessel while the reduced pressure is maintained, said first continuous conveyor for transporting the material into said inlet end of said vessel including:

an inlet hopper for the material;

a cylindrical member extending from said hopper to said inlet end of said pressure vessel; and a worm screw positioned for rotation within said cylindrical member from said hopper to said inlet end of said pressure vessel which transports the material from said hopper to said inlet end of said pressure vessel, said worm screw having a predetermined outer diameter and said cylindrical member having an inner cylindrical surface of a diameter generally similar to said predetermined outer diameter of said worm screw, a predetermined length so that the material in said hopper and said cylindrical member acts to prevent the passage of air therethrough, an inlet end at said hopper and an outlet end in said vessel, said outlet end including a plurality of openings transverse to said means for transporting the material in the vessel from the inlet end to the outlet end thereof for distributing said material thereon.

2. A dryer for material including:

a pressure vessel having an inlet end and an outlet end;

means for reducing the pressure within said vessel;

means for introducing microwave energy into said vessel;

means for transporting the material in the vessel from the inlet end to the outlet end while the material is being subjected to microwave energy at the reduced pressure for at least a portion of the travel thereof;

a first continuous conveyor for transporting the material into said inlet end of said vessel while the reduced pressure is maintained; and a second continuous conveyor for transporting the material from said outlet and of said vessel while the reduced pressure is maintained, said first continuous conveyor for transporting the material into said inlet end of said vessel including:

an inlet hopper for the material;

a cylindrical member extending from said hopper to said inlet end of said pressure vessel; and a worm screw positioned for rotation within said cylindrical member from said hopper to said inlet end of said pressure vessel which transports the material from said hopper to said inlet end of said pressure vessel, said worm screw having a predetermined outer diameter and said cylindrical member having an inner cylindrical surface of a diameter generally similar to said predetermined outer diameter of said worm screw, a predetermined length so that the material in said hopper and said cylindrical member acts to prevent the passage of air therethrough, an inlet end at said hopper and an outlet end in said vessel, said vessel including an inlet hopper into which said material is transported by said first continuous conveyor, said means for transporting the material in the vessel from the inlet end to the outlet end while the material is being subjected to microwave energy at the reduced pressure including, a conveyor belt having input and output ends, first and second opposite end rollers at said input and output ends of said conveyor belt, and a plurality of intermediate rollers between said first and second opposite end rollers positioned to shape the belt portion adjacent thereto into a trough for transporting the material.

3. The dryer as defined in claim 2 wherein said inlet hopper includes an adjustable baffle wall having a lower lip whose height above said belt determines the height of the material being transported on said belt.

4. The dryer as defined in claim 3 wherein said belt has a conveyor surface with opposite sides, and said vessel includes a microwave chamber into which said microwaves are introduced and the material is transported by said belt, said chamber is formed by said adjustable baffle wall, a similar back wall adjacent said outlet conveyor means and a pair of side shields on the opposite sides of said belt.

5. The dryer as defined in claim 4 wherein said side shields are perforated to allow water vapor to pass therethrough.

6. The dryer as defined in claim 4 wherein said vessel includes condenser means positioned beneath said belt to condense the water vapor being removed from the material.

7. The dryer as defined in claim 6 wherein said vessel further includes:

a sump in which the water vapor condensed by said condenser means collects; and a sump pump to pump the condensate in said sump out of said vessel.

8. The dryer as defined in claim 4 wherein said chamber includes means therein to stir the material being transported by said belt.

9. The dryer as defined in claim 8 wherein said means therein to stir the material being transported by said belt include:

a stationary plow positioned adjacent said belt in the center of said microwave chamber.

10. The dryer as defined in claim 2 wherein said vessel includes an outlet bin from which said second cntinuous conveyor transports material, said outlet bin being positioned adjacent and beneath said second opposite end roller.

11. The dryer as defined in claim 10 wherein said outlet bin includes a scraper in contact with said belt to assure that the material thereon is removed therefrom and falls into said outlet bin.

12. The dryer as defined in claim 10 wherein said second continuous conveyor includes:

a second cylindrical member extending from said outlet bin out of said pressure vessel; and a second worm screw positioned for rotation within said second cylindrical member to transport material from said outlet bin out of said pressure vessel which transports the material from said outlet bin out of said pressure vessel.

13. The dryer as defined in claim 12 wherein said second worm screw has a predetermined outer diameter and said second cylindrical member has an inner cylindrical surface of a diameter generally similar to said predetermined outer diameter of said second worm screw.

14. The dryer as defined in claim 13 wherein said second cylindrical member has a predetermined length so that the material in said bin and said second cylindrical member act to prevent the passage of air back therethrough.

15. A dryer for material including:

a pressure vessel having an inlet end and an outlet end;

means for reducing the pressure within said vessel;

means for introducing microwave energy into said vessel;

means for transporting the material in the vessel from the inlet end to the outlet and while the material is being subjected to microwave energy at the reduced pressure for at least a portion of the travel thereof;

a first continuous conveyor for transporting the material into said inlet end of said vessel while the reduced pressure is maintained; and a second continuous conveyor for transporting the material from said outlet end of said vessel while the reduced pressure is maintained, said first continuous conveyor for transporting the material into said inlet end of said vessel including:

an inlet hopper for the material;

a cylindrical member extending from said hopper to said inlet end of said pressure vessel; and a worm screw positioned for rotation within said cylindrical member from said hopper to said inlet end of said pressure vessel which transports the material from said hopper to said inlet end of said pressure vessel, said worm screw having a predetermined outer diameter and said cylindrical member having an inner cylindrical surface of a diameter generally similar to said predetermined outer diameter of said worm screw, and a predetermined length so that the material in said hopper and said cylindrical member acts to prevent the passage of air therethrough, said vessel further including: an inlet hopper into which said material is transported by said first continuous conveyor, said means for transporting the material in the vessel from the inlet end to the outlet end while the material is being subjected to microwave energy at the reduced pressure further including a conveyor belt having input and output ends, first and second opposite end rollers at said input and output ends of said conveyor belt, and a plurality of intermediate rollers between said first and second opposite end rollers positioned to shape the belt portion adjacent thereto into a trough for transporting the material.

16. The dryer as defined in claim 13 wherein said inlet hopper includes an adjustable baffle wall having a lower lip whose height above said belt determines the height of the material being transported on said belt.

17. The dryer as defined in claim 16 wherein said belt has a conveyor surface with opposite sides, said vessel including a microwave chamber into which said microwaves are introduced and through which the material is transported by said belt, said chamber being defined by said adjustable baffle wall, a similar back wall adjacent said outlet conveyor means and a pair of side shields on the opposite sides of said belt.

18. The dryer as defined in claim 17 wherein said side walls are perforated to allow water vapor to pass therethrough, said vessel including;

condenser means positioned beneath said belt to condense the water vapor being removed from the material;

a sump in which the water vapor condensed by said condenser means collects; and a sump pump to pump the condensate in said pump out of said vessel.

19. The dryer as defined in claim 17 wherein said chamber includes means therein to stir the material being transported by said belt.

20. The dryer as defined in claim 19 wherein said means therein to stir the material being transported by said belt include:

a stationary plow positioned adjacent said belt in the center of said microwave chamber.

21. The dryer as defined in claim 15 wherein said vessel includes an outlet bin from which said second continuous conveyor transports material, said outlet bin being positioned adjacent and beneath said second opposite end roller.

22. The dryer as defined in claim 21 wherein said outlet bin includes a scraper in contact with said belt to assure that the material thereon is removed therefrom and falls into said bin.

23. The dryer as defined in claim 22 wherein the material is in powdered form.

* * * * *